US005994976A

United States Patent [19]

Tang

[11] Patent Number: 5,994,976

[45] Date of Patent: Nov. 30, 1999

[54] DUAL COMPARTMENT MULTI-TAP

[76] Inventor: Danny Q. Tang, 2 Taylorr Lake Ct., Manalapan, N.J. 07726

[21] Appl. No.: 09/126,999

[22] Filed: Jul. 31, 1998

[51] Int. Cl.[6] ..... H01P 5/12

[52] U.S. Cl. ..... 333/100; 174/50; 200/51.1; 333/101; 333/127; 333/128; 439/76.1

[58] Field of Search ..... 333/100, 101, 333/105, 127, 128, 136; 200/51.1; 174/50; 307/119, 147

[56] References Cited

U.S. PATENT DOCUMENTS

| | | | |
|---|---|---|---|
| 5,635,881 | 6/1997 | Romerein et al. | 333/101 |
| 5,648,745 | 7/1997 | Spriester et al. | 333/100 |
| 5,677,578 | 10/1997 | Tang | 333/101 X |
| 5,909,154 | 6/1999 | Brown et al. | 333/100 |

OTHER PUBLICATIONS

Antronix Product Brochure entitled "New Dual Compartment Multi–Tap Milenium 2000", published about Oct. 1997.

Antronix Product brochure entitled "Dual Compartment Housing", published about Oct. 1997.

*Primary Examiner*—Paul Gensler
*Attorney, Agent, or Firm*—Watov & Kapnes, P.C.

[57] ABSTRACT

A multi-tap is described having two compartments, a microstrip in each compartment for conducting RF signals and AC power from an input at one end of the multi-tap to a first output port at the other end, a cover for each compartment having a circuit thereon that is substituted for the microstrip in a compartment when the cover closes that compartment, a device near the first output port that can be adjusted to direct RF signals and AC power passing through the microstrips to a point other than the first output port and additional microstrips for conducting RF signals and AC power from that point, when the RF signals and AC power are present thereat, to a second output port located near the input port. Grounding shields are provided for shorting the additional microstrips when the device is adjusted to deliver RF signals and AC power to the first output port. When the cover of a compartment is closed, it activates a switches formed in part by ends of the microstrips.

10 Claims, 16 Drawing Sheets

DUAL COMPARTMENT MULTI-TAP

FIELD OF THE INVENTION

The field of the present invention relates generally to cable television and RF signal distribution equipment, and more specifically to multi-taps and similar devices.

BACKGROUND OF THE INVENTION

CATV systems use hundreds of multi-taps to provide RF and AC power to subscribers through coaxial drops. The multi-taps are eventually upgraded or replaced due to damage, product improvement, etc.. Since the housings of the multi-taps are fixed in length (typically about four inches) and it is very difficult to remove the connectors from the coaxial cable, most installers simply cut the coaxial cable at the connector base and install another connector in the cable. Since a multi-tap housing length is fixed, the shortened coaxial cable might not reach and fit into the multi-tap. A prior solution is to replace the removed shorter housing with a relatively longer multi-tap housing. For example, a nine-inch multi-tap housing is long enough to accommodate the upgrade of all standard multi-taps in the industry. It is known in the art to utilize this idea by simply using a single base plate or top plate in the longer housing.

Furthermore, different amounts of RF power must often be tapped off to different users because they are at respectively different distances from a multi-tap. Whereas this could be affected by designing the circuits in the multi-tap in such a manner that they provide the required levels of power to each subscriber input port to which the cables are coupled, this would be very expensive. Therefore, it has been customary for all of the tap-offs of a multi-tap to provide the same amount of power. Since the circuits are mounted on the inside of a removable cover known as a tap plate for the multi-tap, it is necessary to change tap plates to supply a desired amount of tap-off power to a group of subscribers.

There are situations, such as in apartment houses, wherein a large number of multi-taps are required. With present multi-taps in which input ports are at one end and output ports at the other, the interconnections such between a plurality of multi-taps for accommodating a huge number of subscribers can be rather complicated, and require a huge amount of space for mounting the multi-taps. This is an additional problem to those mentioned above.

SUMMARY OF THE INVENTION

The present invention overcomes the problems in the art by providing a dual compartment nine-inch housing in one embodiment that provides backward compatibility with prior single housing tap plates. This feature allows flexibility for the CATV installers to use types of tap plates in a dual compartment housing, e.g., equalizers, filters, with various functionality dB value taps, etc. Also, double the number of subscriber ports can be provided due to the dual compartment housing configuration. It also can use the current single compartment tap plate in the new nine-inch dual compartment housing.

In other words, the provision of two compartments makes it possible to provide one compartment with a standard tap plate and the other compartment with a tap plate providing entirely different functions.

In accordance with this invention, ends of first and second multi-taps, each having its own tap plate, are joined together and constructed in such manner that RF signals and AC power can flow from an input port at the unjoined end of the first multi-tap, through the first and second multi-taps to an output port at the unjoined end of the second multi-tap, or back through both multi-taps via microstrip lines in each multi-tap to an output port at the unjoined end of the first multi-tap, for example. Thus, there is an input port and an output port at the unjoined end of the first box that are close together so as to make it easy to connect them to the cut ends of an underground cable.

When the multi-tap is configured so that the desired flow of RF signals is out of the output port at the unjoined end of the second multi-tap and not back through the multi-taps via the microstrip lines referred to, it has been found that these microstrip lines interfere with the desired flow of signals. In order to prevent this from occurring, special conductive ground shields are provided that can be placed over the microstrip lines in each multi-tap.

As indicated, the present dual compartment housing permits great flexibility to an installer. Conventional tap plates provide tap-offs for either two, four, or eight subscribers, respectively, and may each provide different tap-off power. Accordingly, the use of the present dual compartment will reduce the inventory requirements of the cable installer.

BRIEF DESCRIPTION OF THE DRAWINGS

Various embodiments of the invention are described in detail below with reference to the drawings, in which like items are indicated by the same reference designation, wherein.

DETAILED DESCRIPTION OF THE INVENTION

Figure 1:
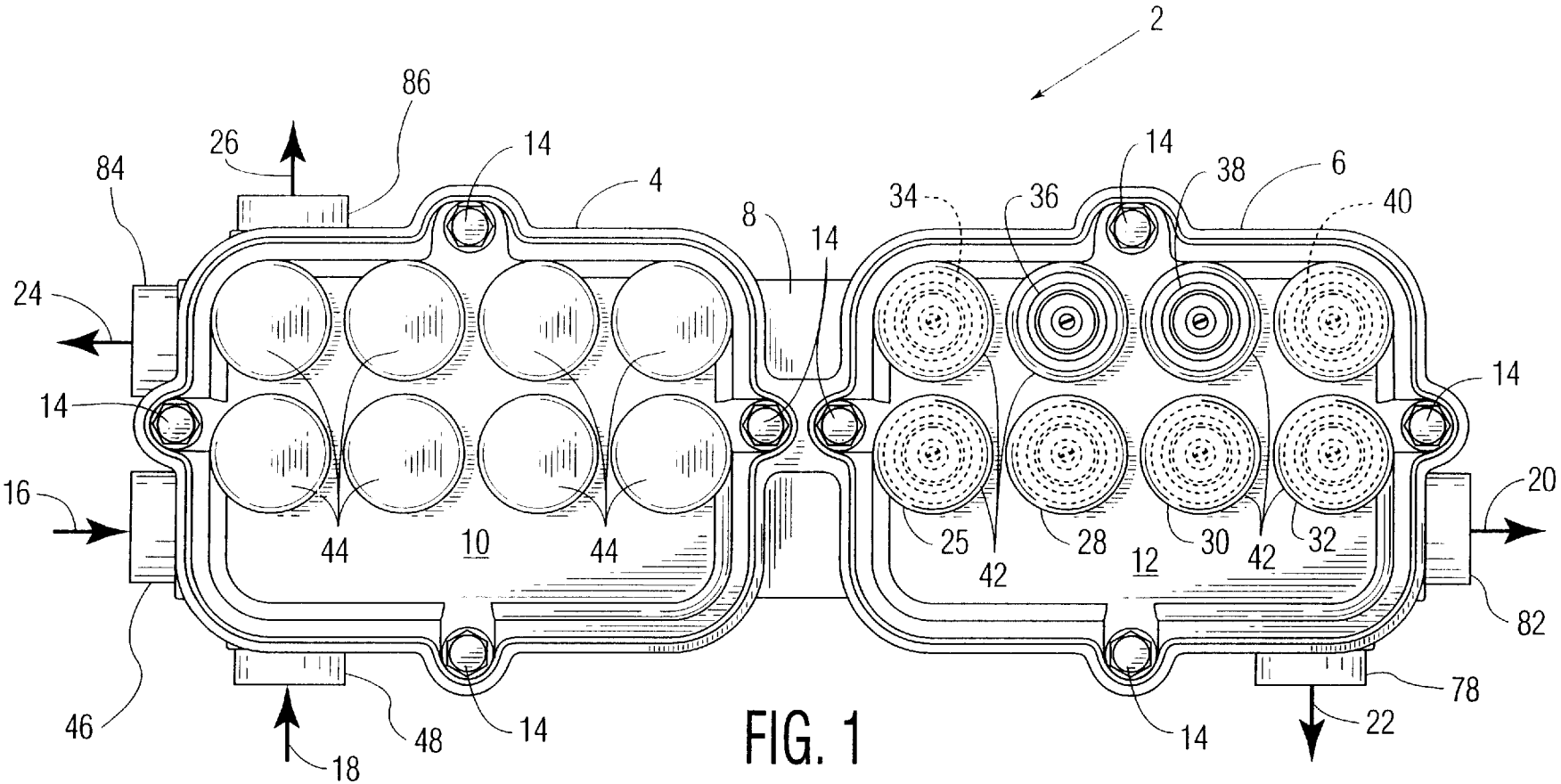
FIG. 1 is a bottom view of a multi-tap incorporating this invention with the covers in place.

FIG. 1 shows the bottom of a multi-tap 2 of the invention that one would see from the ground if the multi-tap were used with an above ground system cable. In its preferred form, the multi-tap 2 is comprised of two sections 4 and 6 that are joined together by a wall as indicated at 8. Each of the sections 4 and 6 have compartments therein that are not seen in this view because they are covered by tap plate covers 10 and 12 respectively that are attached by bolts 14. The possible inward and outward flows of RF signals and AC power are indicated by arrows. The RF and AC can enter the section 4 at an end input port 46 thereof as indicated by an arrow 16 or they can enter at a side input port 48 thereof as indicated by an arrow 18. After flowing through the sections 4 and 6 of the multi-tap 2, they can exit from an output port 82 at the end of the section 6 as indicated by an arrow 20 or from an output port 78 at its side as indicated by an arrow 22. Alternatively, the RF and AC may be returned through the sections 6 and 4 so as to exit at an output port 84 at the end of the section 4 as indicated by an arrow 24 or from an output port 86 at its side as indicated by an arrow 26. Whichever path the RF and AC follow, they may be coupled to coax connectors at locations 25, 28, 30, 32, 34, 36, 38 and 40 in the tap plate cover 12 for connection to user cables. Tap plates can be provided with different numbers of connectors 42, but in FIG. 1 only two connectors 36 and 38 are shown. The other connectors are closed by protective caps at the locations 25, 28, 30, 32, 34, and 40.

In this particular embodiment of this invention; no outlets for RF and AC are provided in the cover 10, but if desired they could be located at any of the circles 44. In this case, the outlets of the tap plate cover 12 could be provided with different amounts of the RF power than outlets of the tap plate cover 10. Alternatively, the tap plate cover 10 of section 4 could contain circuits for performing functions other than distributing RF and AC to user cables.

The fact that the RF and AC can enter the multi-tap 2 at a point indicated by the arrow 16 and can leave at a point indicated by the arrow 24 that are closer together than in a typical multi-tap is because they are at the same end of the multi-tap 2. This permits them to be easily coupled to the cut ends of a buried system cable in the bottom of a housing of small cross-section.

Figure 2:
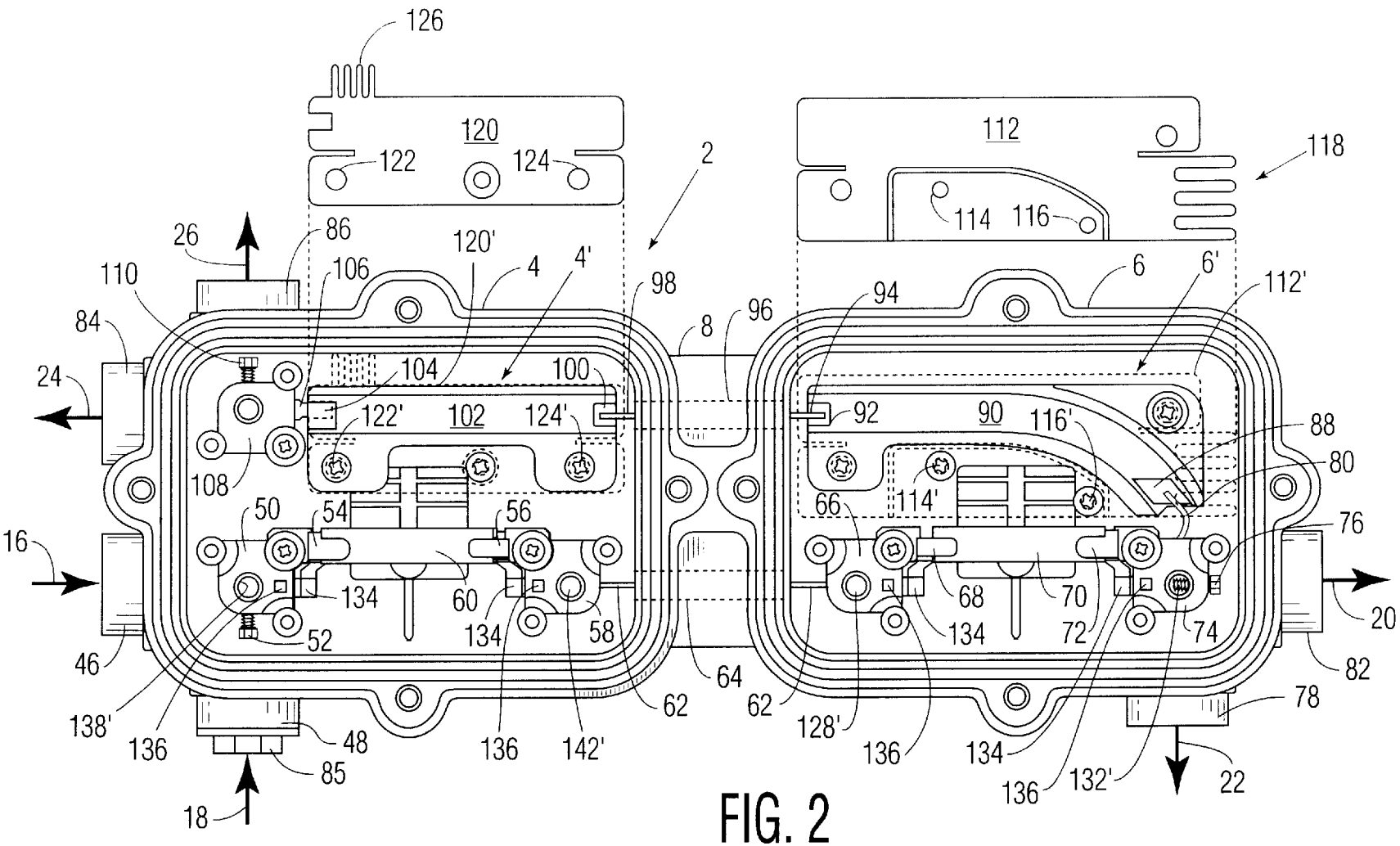
FIG. 2 is a bottom view of a multi-tap of this invention with the covers removed and the RF and AC passing through the multi-tap and back to the end where they were introduced.

Reference is now made to FIG. 2 for a description of the circuitry for guiding the RF and AC along the paths just described in connection with FIG. 1. In FIG. 2, the tap plate cover 10 and the tap plate cover 12 are removed so that compartments 4' and 6' respectively contained in the sections 4 and 6 are visible. A cut end of a system cable, not shown, that carries RF and AC is to be coupled to the input port 46 or to the input port 48 so as to introduce the RF and AC into the compartment 4' in the direction of the arrows 16 or 18 respectively. The shield of the coax cable would be connected to the multi-tap 2 so that it is grounded, but the central conductor, not shown, would extend into the compartment 4' and into a passageway in a cable seizure means 50 where it is clamped by a screw 52. The cable seizure means 50 serves as an internal connector. As shown, the screw 52 would clamp the central conductor of a cable coupled to the input port 46, but the screw and passageway can be rotated 90° so as to clamp the central conductor of a cable coupled to input port 48.

In either position of the cable seizure means 50, the RF and AC appear at its output 54 and are normally conducted to an input 56 of a nearly identical cable seizure means 58 via a microstrip transmission line 60. Since the cable seizure means 58 permanently connects its input 56 to a conductor 62 that is thrust into a passageway, not shown, within it, a screw like 52 is not required, and the conductor 62 is soldered to the passageway.

The RF and AC on the conductor 62 are transmitted to the compartment 6' by passing them through a passageway 64 shown in dashed lines so as to in effect form a coaxial cable.

A cable seizure means 66 that is like the cable seizure means 58 connects the conductor 62 to its output 68, and a microstrip or other type of transmission line 70 is normally connected between the output 68 of the cable seizure means 66 and an input 72 of a cable seizure means 74 that is like the cable seizure means 50. When a screw 76 in the cable seizure means 74 is in the position shown, a passageway, not shown, extending through the seizure means 74 is aligned with the arrow 22 so as to be able to receive the central conductor of a cable coupled to the output port 78 in one end or a conductor 80, to be described, in the other end. Of course, only one conductor will be present at a time. By rotating the screw 76 and passageway 90°, the center conductor of a cable coupled to the output port 82 can be inserted in the passageway and clamped by tightening the screw 76.

A port plug like 85 that is attached to the input port 48 is attached to any port of the multi-tap 2 to which a cable is not connected in order to prevent insects, dirt or moisture from entering either of the compartments 4' or 6'.

When it is desired to return the RF and AC back through the compartments 6' and 4' to a cable coupled to the output port 84 or to a cable coupled to the output port 86 at the other end of the multi-tap 2, the conductor 80 is inserted into the passageway, not shown, in the cable seizure means 74 and clamped by the screw 76. The conductor 80 is connected to a free end 88 of a microstrip 90, and the other end 92 of the microstrip line 90 is connected to one end of a conductor 94 that extends through a passageway 96 shown in dashed lines between the compartments 6' and 4' so as to in effect form a coaxial cable. The other end 98 of the conductor 94 is connected to an end 100 of a microstrip 102, and the other end 104 of the microstrip 102 is connected to an input 106 of a cable seizure means 108 that is like the cable seizure means 50. The cable seizure means 108 has a screw 110, and a passageway, not shown, intersecting the screw, as in the cable seizure means 50 and 74. By rotation of the screw 110 and the unseen passageway, the input 106 may be connected to the center conductor of a cable coupled to the output port 84 or to the center conductor of a cable coupled to the output port 86.

Should it be desired to have the RF and AC exit the compartment 6' via a cable coupled to the output port 82 or via a cable coupled to the output port 78, the conductor 80 is removed from the unseen passageway in the cable seizure means 74. In this situation, however, the transmission of RF may be adversely affected by coupling between the microstrip 70 in the compartment 6', and possibly other components connected to it, and the microstrip 90 and by coupling between the microstrip 60 in the compartment 4', and possibly other components connected to it, and the microstrip 102. In order to prevent such coupling, a metal shield 112 is mounted in the location as indicated by a dashed line 112' by screws passing through holes 114 and 116 in the shield 112 and threaded into holes 114' and 116' in the body of the multi-tap 2 respectively. The shield 112 is equipped with fingers 118 at one end that make spring contact with the inside of the compartment 6' so as to make a good ground connection. Similarly, a metal shield 120 is mounted within the compartment 4' in a location indicated by a dashed line 120' by screws passing through holes 122 and 124 and threaded into holes 122' and 124' respectively. Fingers 126 make string contact with the inside of the compartment 4' so as to make a good ground connection.

Figure 3:
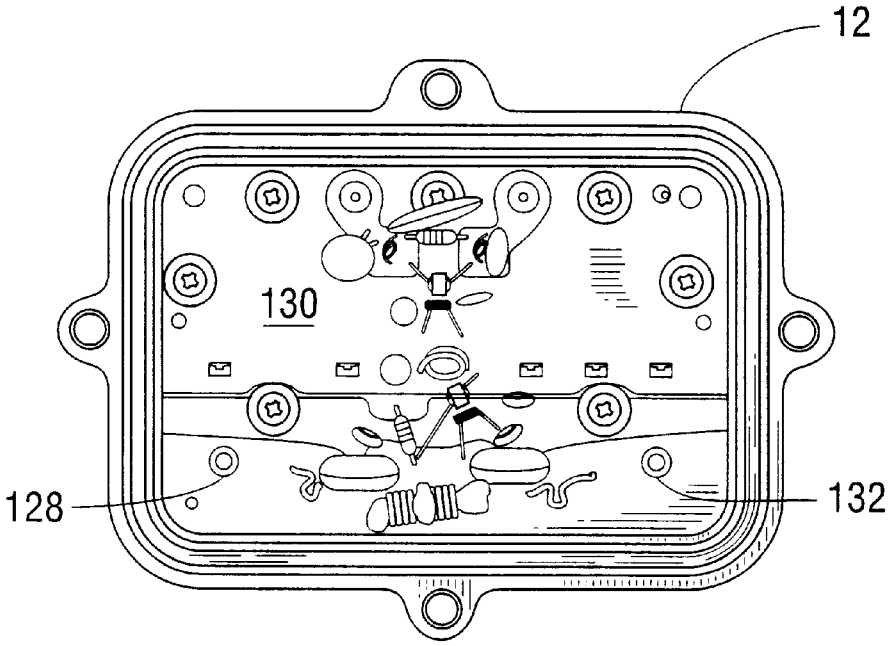
FIG. 3 is a view of the inside of a cover having a circuit board of the type used to distribute RF signals and AC power to outlets for users' cables.

FIG. 3 illustrates the underside of the tap plate cover 12 that closes the open side of the compartment 6'. As explained in U.S. Pat. No. 5,677,578 issued on Oct. 14, 1997, and which is incorporated by reference herein to the extent it does not conflict herewith, a post 128 is connected to the input of a circuit on a circuit board 130, and a post 132 is connected to the output of the circuit. The posts 128 and 132 are located so that they are respectively inserted into socket spring inserts 128' and 132' in the cable seizure means 66 and 74 (see FIG. 2) when the tap plate cover 12 closes the compartment 6'. The socket spring insert 128' is formed in the top of a metal cylinder or seizure socket having a passageway or hole, not shown, in which the conductor 62 is soldered. The seizure socket is connected by a normally closed switch 134 to the output 68. With reference to FIGS. 2 and 3, a cam spring cap 136 from the body of the cable seizure means 66 is pushed down by the circuit board 130 so as to open the switch 134 and disconnect one end of the microstrip 70 preferably just after electrical contact is made between the post 128 and the socket spring insert 128'. Thus, in a preferred embodiment of this invention, the cable seizure means 66 is an input to two switches, a first switch being the switch 134 and the second switch being formed by the socket spring insert 128' and the post 128. When the tap plate cover 12 is not in position, the first switch is closed so as to connect the conductor 62 to the microstrip 70, and the second switch is open. As the cover 12 is closing the compartment 6', the second switch is closed before the first switch is opened so as not to even momentarily interrupt the flow of R.F. and A.C. to downstream users. When the tap plate cover 12 is being opened, the second switch is closed so as to connect the conductor 62 to the input of its circuit before the first switch is opened so as to ensure that there will not be an interruption in the flow of R.F. and A.C. to downstream users.

Since the components of the cable seizure means 74, 50, and 58 operate in the same way in response to the positioning of a tap plate cover as has just been described, explanation of their operation is not necessary. Their switches are also designated by 134 and their cam spring caps by 136 as in the description just made of the cable seizure device 66.

Figure 4:
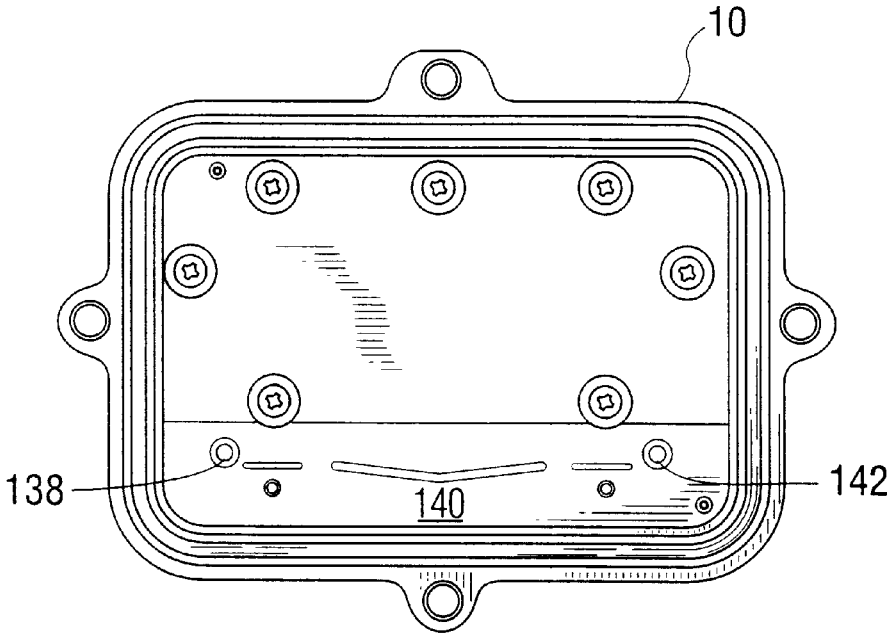
FIG. 4 is a view of the inside of a cover that simply passes RF signals and AC power through its multi-tap.

Reference is now made to FIGS. 2 and 4. FIG. 4 illustrates the underside of the cover 10 in which an electrical connector post 138 is connected to the input of a microstrip 140 on a printed circuit board not having taps, and an electrical connector post 142 is connected to the output of the microstrip 140. When the cover 10 is positioned so as to close the compartment 4' in FIG. 2, the electrical connector post 138 slides into a socket spring insert 138' in the cable seizure means 50, and the electrical connector post 142 slides into a socket spring insert 142' in the cable seizure means 58. Since the switches 134 are normally closed, the microstrip 60 is in the circuit until the cover 10 is positioned to close the compartment 4' at which point the microstrip 140 is substituted for it. It will be understood that in accordance with one aspect of this invention, a circuit board like 130 on the cover 12, or an entirely different circuit board could be substituted for the microstrip 140.

Figure 5:
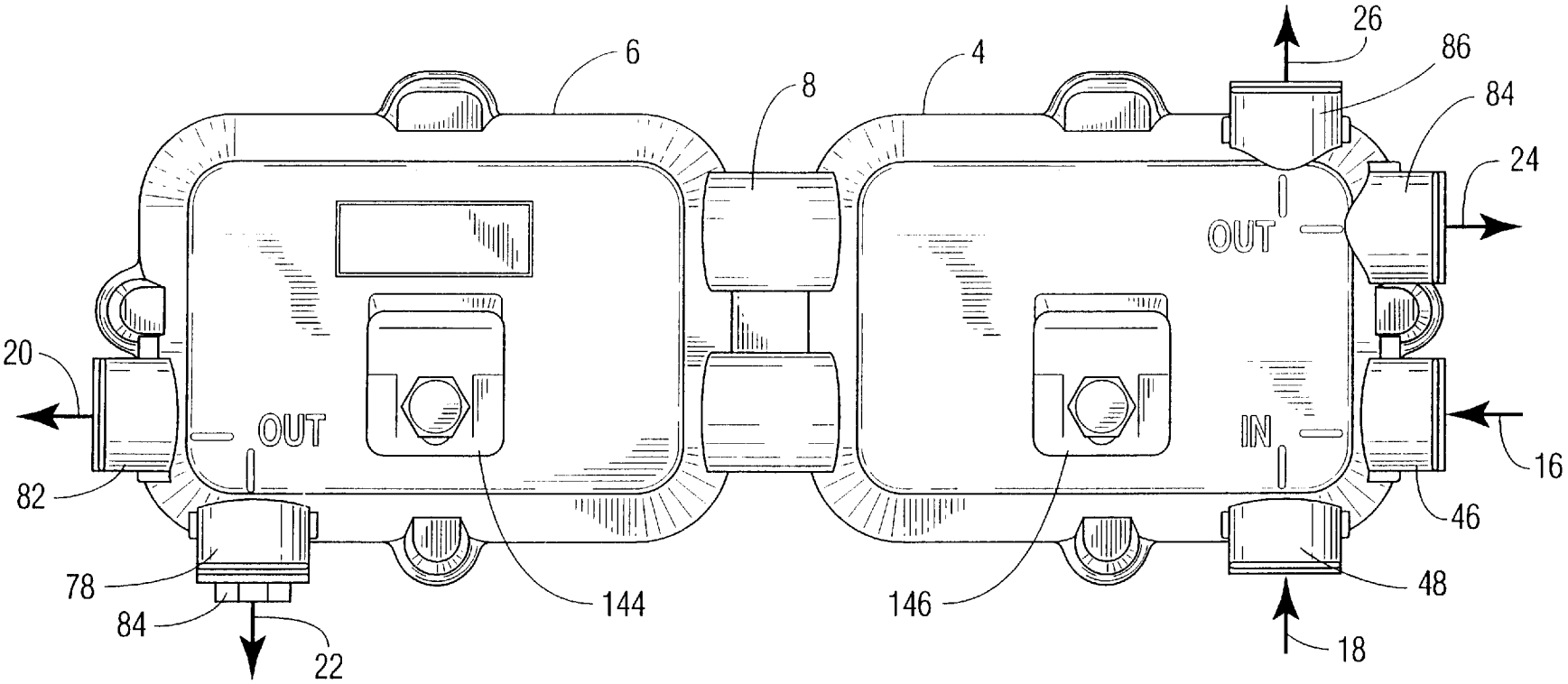
FIG. 5 is a view of the top of a multi-tap incorporating this invention.

FIG. 5 shows the top of the multi-tap 2 as it would appear when used with an above ground system cable. Clamps 144 and 146 are used to hold it in position.

Figure 7:
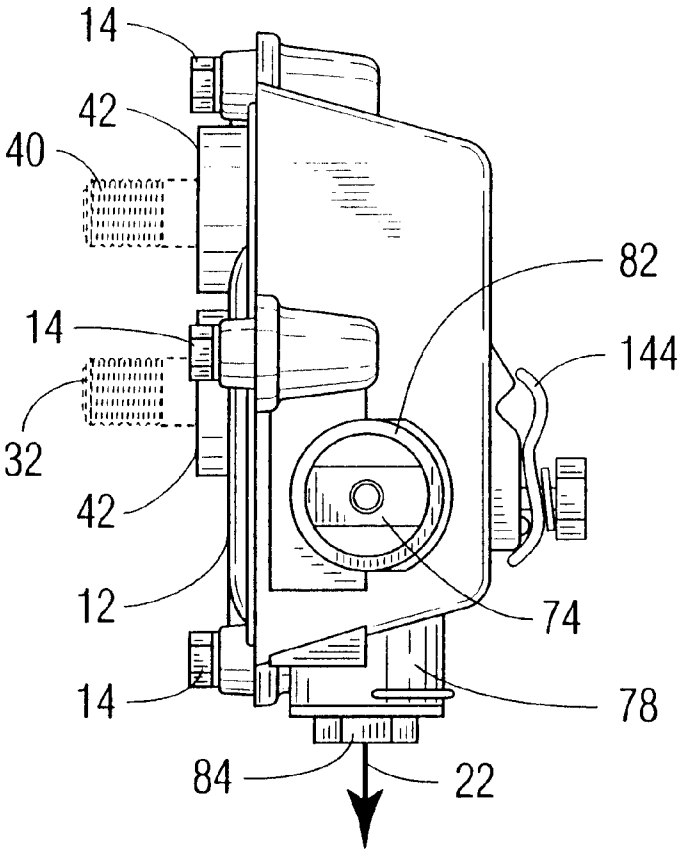
FIG. 7 is a view of the end of a multi-tap of this invention that has a single output cable connector.
Figure 6:
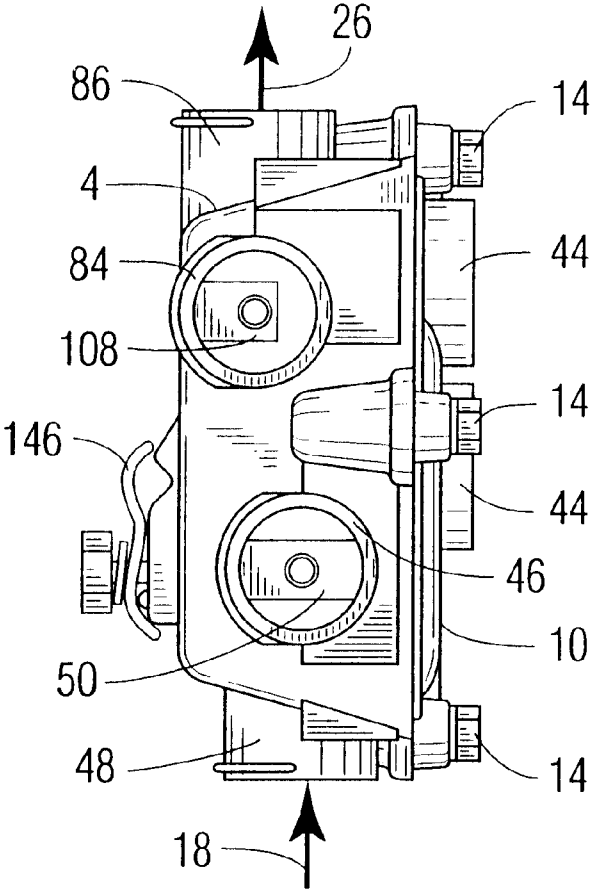
FIG. 6 is a view of the end of a multi-tap of this invention having, both input and output cable connectors.

FIG. 6 shows the end of the section 4 of the multi-tap 2 that has the input port 46 and the output port 84, and FIG. 7 shows the other end of the multi-tap 2.

Figure 8:
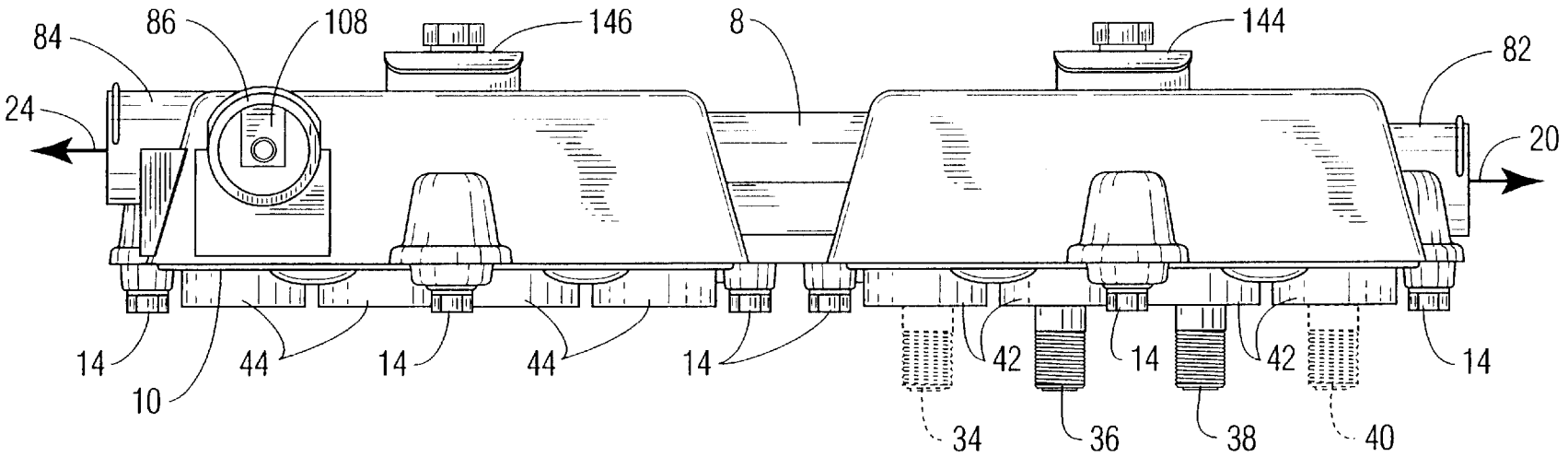
FIG. 8 is a view of one side of a multi-tap of this invention.
Figure 9:
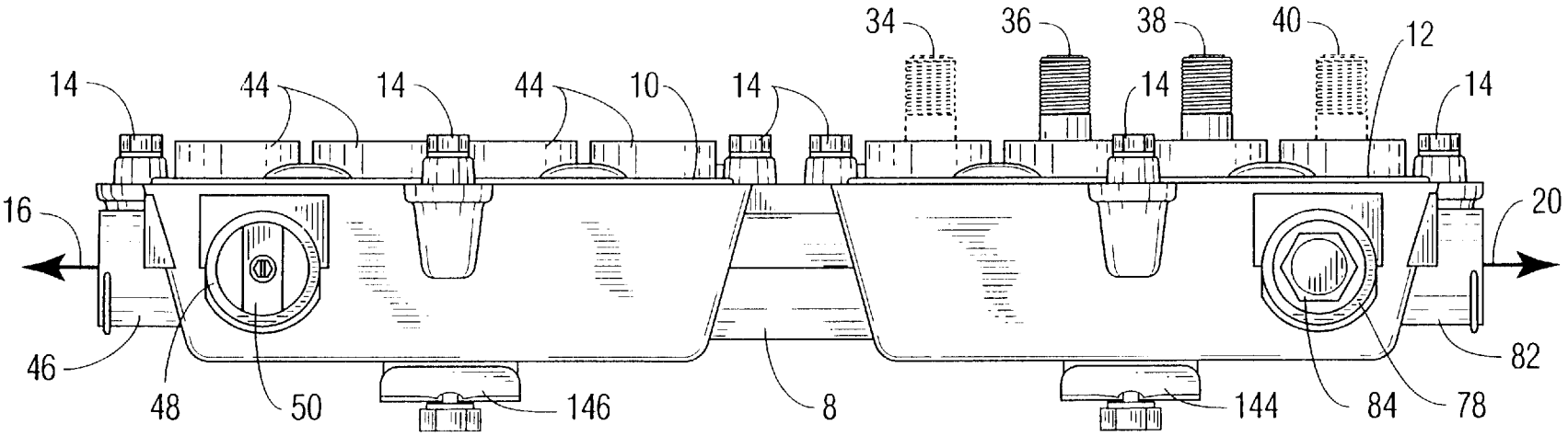
FIG. 9 is a view of the side of a multi-tap of this invention opposite to that shown in FIG. 8.
Figure 10A:
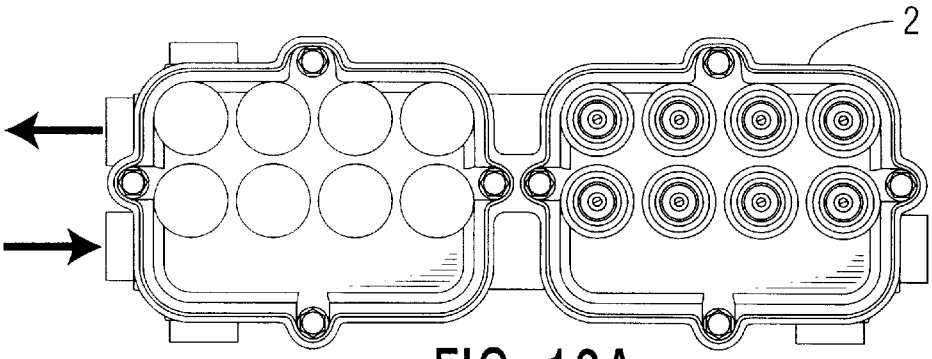
FIGS. 10A through 10H illustrate paths that can be followed by RF and AC in a multi-tap of this invention.
Figure 10B:
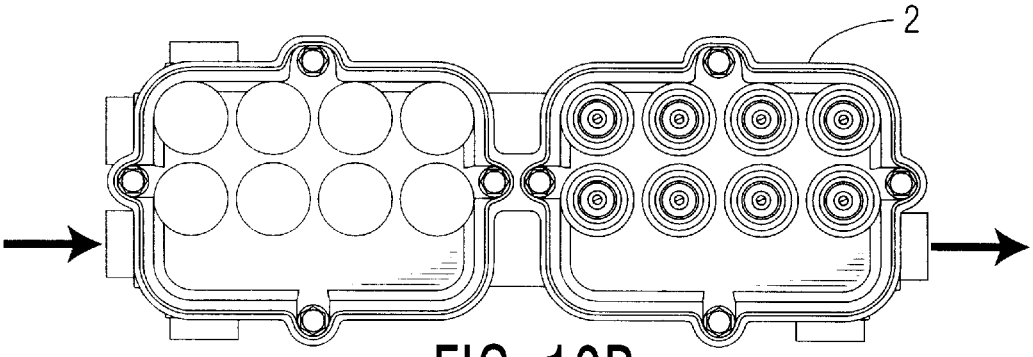
Figure 10C:
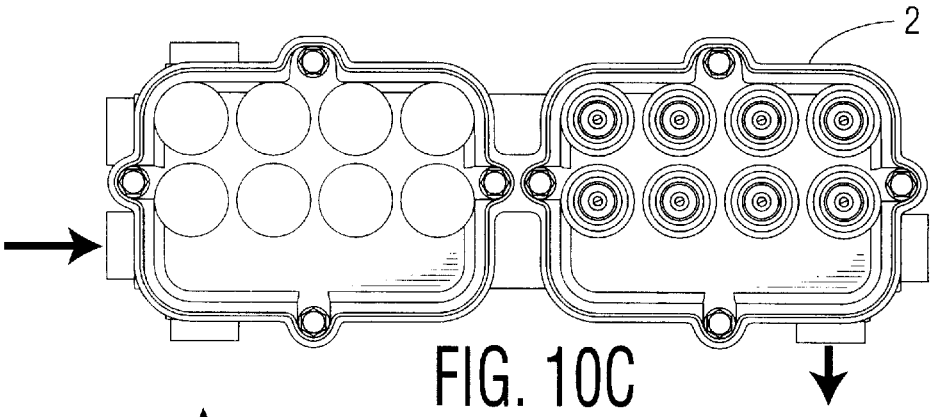
Figure 10D:
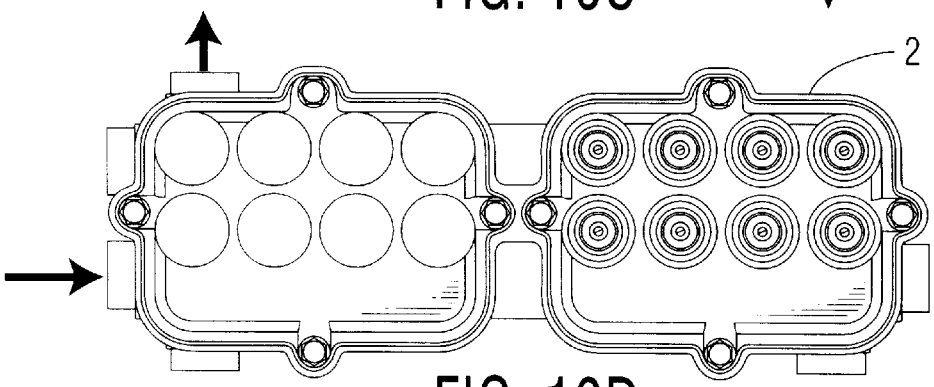
Figure 10E:
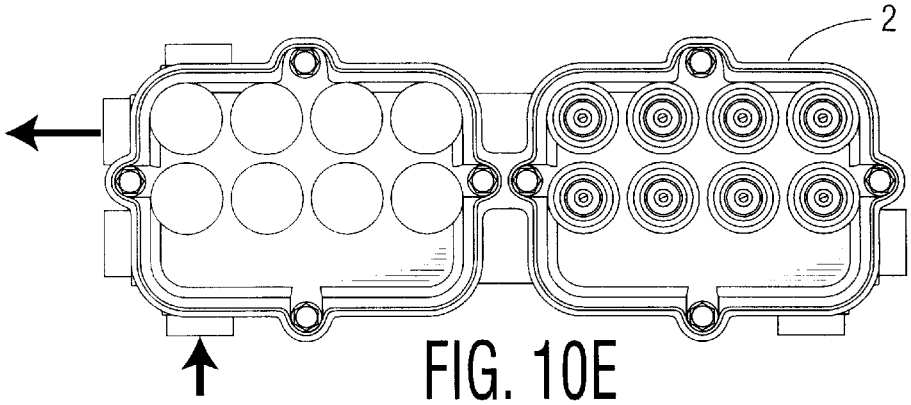
Figure 10F:
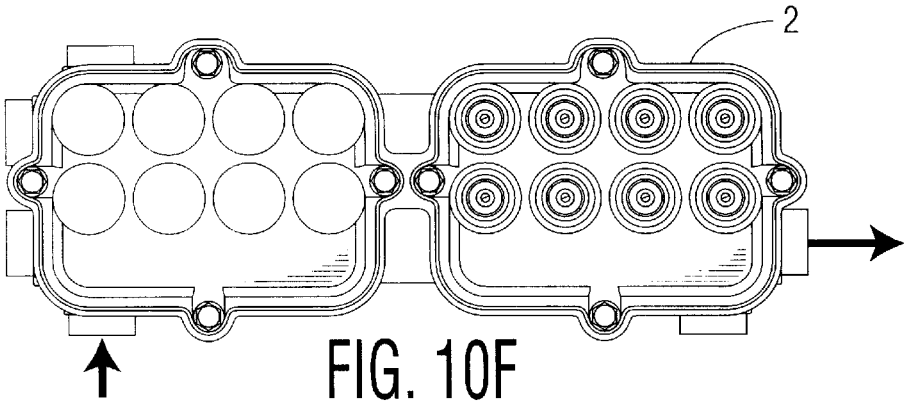
Figure 10G:
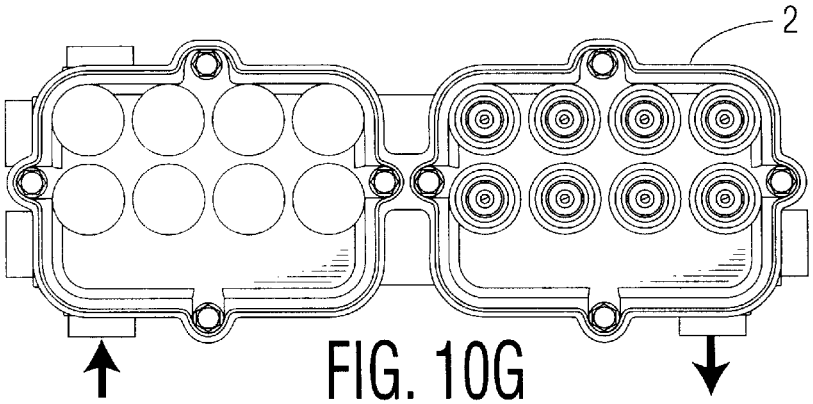
Figure 10H:
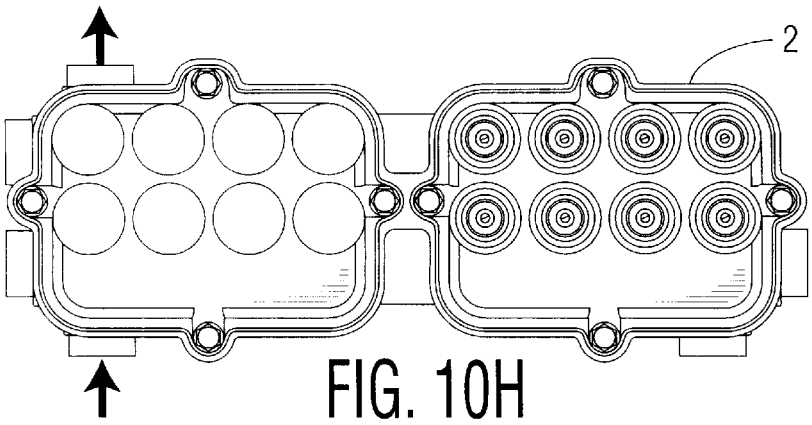

FIGS. 8 and 9 arc opposing side views of the multi-tap 2.

FIGS. 10A through 10H illustrate by way of arrows different paths that RF and AC may follow in passing through a multi-tap of this invention.

Figure 11:
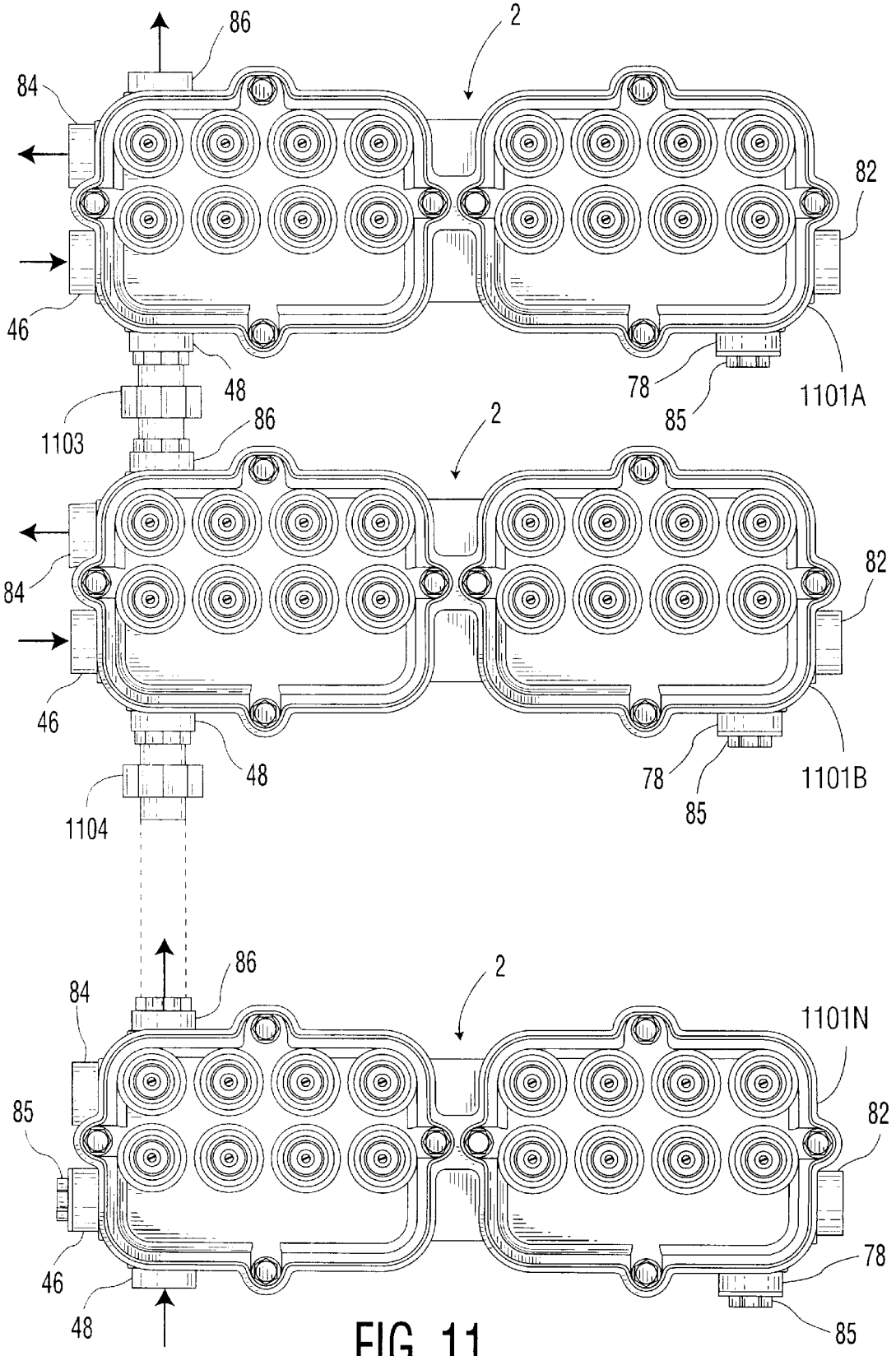
FIG. 11 illustrates another way in which multi-taps of this invention can be coupled together.
Figure 12:
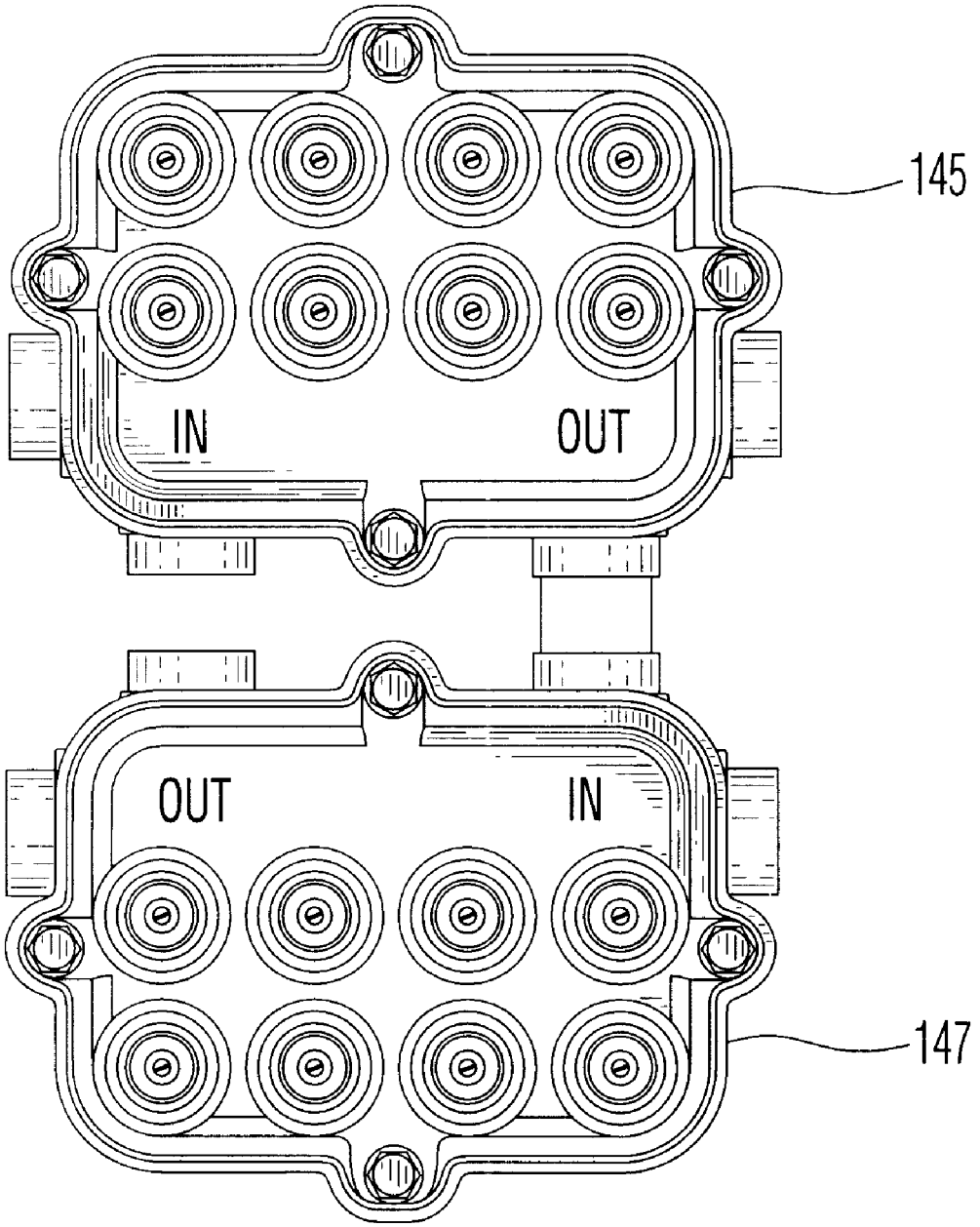
FIG. 12 PRIOR ART
FIG. 12 illustrates a problem in vertically coupling multi-taps of the prior art together.

One of the advantages of a multi-tap 2 of this invention is the large number of ways in which a number of them can be coupled together, one of which is as shown in FIG. 11, using coupling cable assemblies 1103 and 1104 for example. This, feature would be especially advantageous when a large number of users are in the same building. In FIG. 11, for example, the fact that an output port 86 is provided, which is at the same end of a multi-tap 2 as an opposing input port 48, permits any number of multi-taps 2 to be mounted in vertical columns illustrated by multi-taps 1101A, 1101B . . . 1101N. FIG. 12 shows that two multi-taps 145 and 147 of the prior art cannot be mounted in this manner because input and output ports are on the same side of the multi-tap. Similarly, through use of input port 46 of a multi-tap 2 being coupled to an output port 82 of another multi-tap 2, any practical number of multi-taps 2 can be connected in a horizontal place or in a row.

In the embodiments of the invention thus far described, microstrips are provided in the compartments 4' and 6' for conducting signals through the compartments when the covers are not in place so as not to interrupt the flow to downstream users, but such microstrips are not necessary if a shunt is established around the multi-tap before a cover is removed.

In the dual compartment multi-tap just described, the constructions of the cable seizure means 50, 58, 66, 74 and the transmission lines 60 and 70 arc the same as in the aforesaid patent wherein the transmission lines 60 and 70 are mounted on circuit boards that are attached by screws to the cable seizure means at their ends. Electrical contact between ends of the transmission lines 60 and 70 and the adjacent cable seizure means when the covers 10 and 12 are not in place is by way of switches 134 that include a spring contact and other metal components. When the covers 10 and 12 close the compartments 4' and 6' respectively, the cams 136 open the switches 134 by forcing the spring contacts so as to disconnect the ends of the transmission lines 60 and 70. The circuitry on the cover 10 is connected between the cable seizure means 50 and 58, and the circuitry on the cover 12 is connected between the cable seizure means 66 and 74.

In a preferred embodiment of the dual compartment multi-tap of this invention, the ends of transmission lines corresponding to the transmission lines 60 and 70 function as the spring contacts for the switches, and the other metal components for the switches are eliminated. Furthermore, the cable seizure means form an integral unit with the transmission line connected between them so as to ensure the necessary positioning of the transmission line with respect to the cable seizure means.

A preferred embodiment of the dual compartment multi-tap of this invention will now be described by reference to FIGS. 13 through 17. Since the differences between the preferred embodiment and the embodiment previously described by reference to FIGS. 1 through 12 lie in the use of cable seizure means different from the cable seizure means 50, 58, 66, and 74 and in the manner in which the new cable seizure means are coupled to a transmission line, all other elements of structures are shown in FIGS. 13 through 17 in the same way they were shown in FIGS. 1 through 12 and are designated by the same numbers. Since the cable seizure means and their coupling to a transmission line in the compartments 4' and 6' are nearly the same, only the cable seizure means and transmission line of the compartment 4' will be referred to, but except for the cable seizure means as units, corresponding components in the compartments 4' and 6' are identified by like numerals. Furthermore, like components of all cable seizure means are designated by the same numbers.

Figure 13:
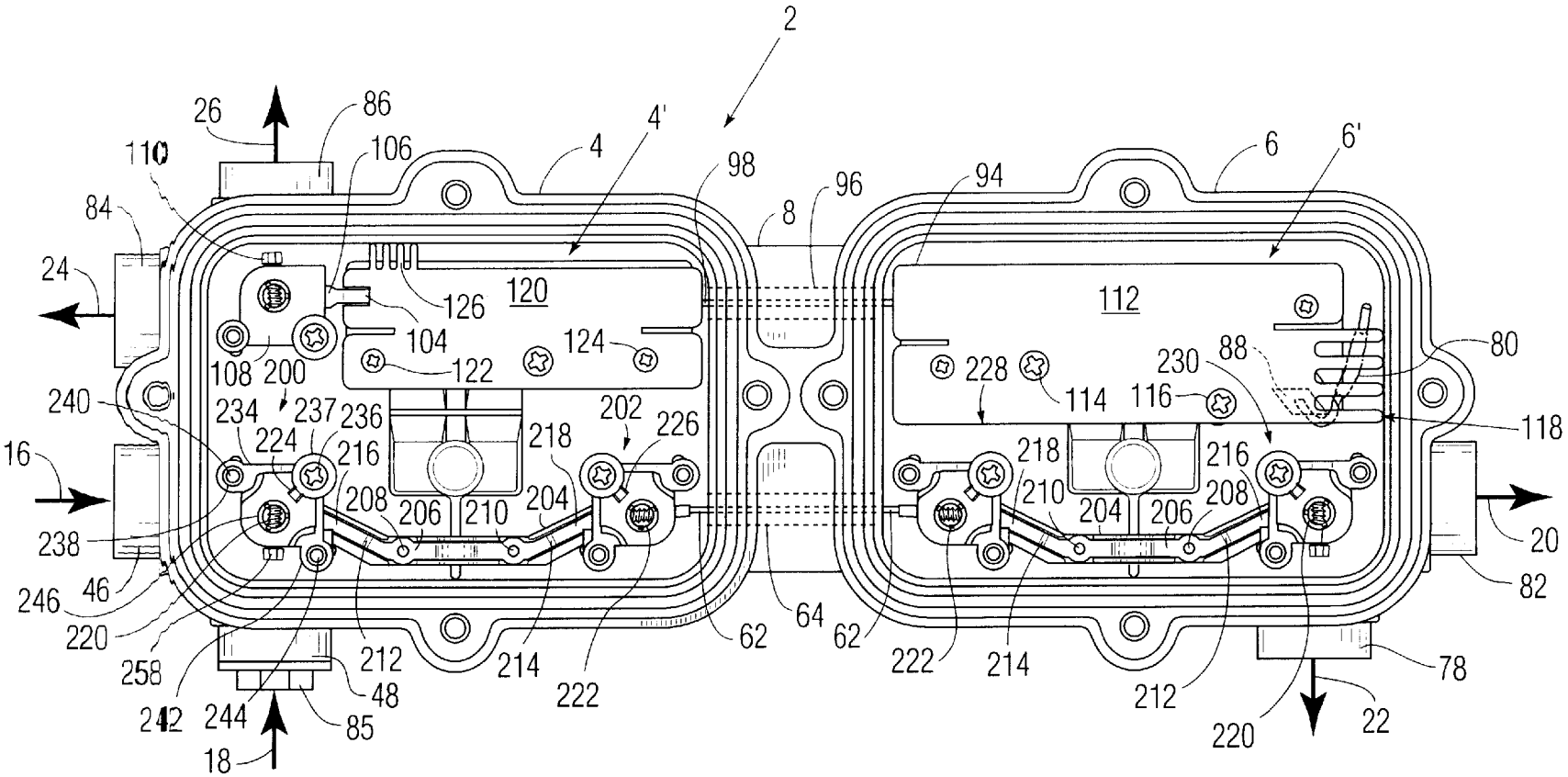
FIG. 13 is a bottom view of a preferred embodiment of a multi-tap of this invention in which the RF and AC only pass through the multi-tap in one direction.

FIG. 13 corresponds to FIG. 2 in that it is a bottom view of a multi-tap with the tap plate covers 10 and 12 removed so as to show the compartments 4' and 6' that are respectively in the sections 4 and 6. In the compartment 4', cable seizure means 200 and 202 that are mounted at its ends are joined by a bridge member 204 so as to form an integral unit of insulating material. A transmission line 206 is attached to the bridge member 204 at points 208 and 210. The transmission line 206 is bent at intermediate points 212 and 214 on either side of its center so that its end portions 216 and 218 slope upwardly from the plane of the paper. As shown in FIG. 16, and as will be explained in connection with FIGS. 17A and 17B, the tips of the end portions 216 and 218 of the transmission line 206 are thereby respectively in resilient electrical contact with metal cylindrical structures inside cable seizure means 200 and 202. Only hollow cylindrical upper portions 220 of the structures are visible in FIG. 13. As will be described by reference to FIGS. 13 and 15, the metal cylindrical structure of the cable seizure means 202 is connected to the cental conductor 62.

When the cover 10 that is shown in FIG. 4 is placed so as to close the compartment 4', the connector post 138 that is connected to one end of the microstrip 140 therein enters the hollow cylindrical upper portion 220 of the metal cylindrical structure of the cable seizure means 200, and the connector post 142 that is connected to the other end of the microstrip 140 enters the hollow cylindrical upper portion 220 of the metal cylindrical structure of the cable seizure means 202 so that the microstrip 140 is connected between a cable connected to either of the coax connectors 46 and 48 and the central conductor 62 that extends between the sections 4 and 6. Just after this connection is made, the circuit board on which the microstrip 140 is mounted pushes cam 224 of the cable seizure means 200 into contact with the end portion 216 of the transmission line 206 and a cam 224 of the cable seizure means 202 into contact with the end portion 218 of the transmission line 206 so as to break their respective resilient contacts with the metal cylindrical structures of the cable seizure means 200 and 202, respectively. Thus the microstrip 140 on the cover 10 is connected between the cable seizure means 200 and 202 before the transmission line 206 is disconnected therefrom, thereby ensuring that the flow of RF and AC to downstream users is not interrupted.

A structure mounted in the compartment 6' is the same as that just described with the exception that the left and right positions of the cable seizure means are interchanged, i.e. a cable seizure means 228 that is like the cable seizure means 202 is located at the left or input end of the compartment 6', and a cable seizure means 230 that is like the cable seizure mean 200 is located at the right or output end of the compartment 6'.

The cover 12 for the compartment 6' is that shown in FIG. 3 so as to include circuits for distributing RF and AC power to various users. Connections to these circuits are made by the electrical connector posts 128 and 132 that are located so as to respectively enter the hollow metal upper cylindrical portion 220 of the cylindrical structures in the cable seizure means 228 and 230 when the cover 12 is closed. Cams 224 operate to depress the end portions 216 and 218 respectively of the transmission line 206 in the compartment 6' and break its connections with the upper portions 220 of the metal cylindrical structures in the cable seizure means 228 and 230.

Figure 14:
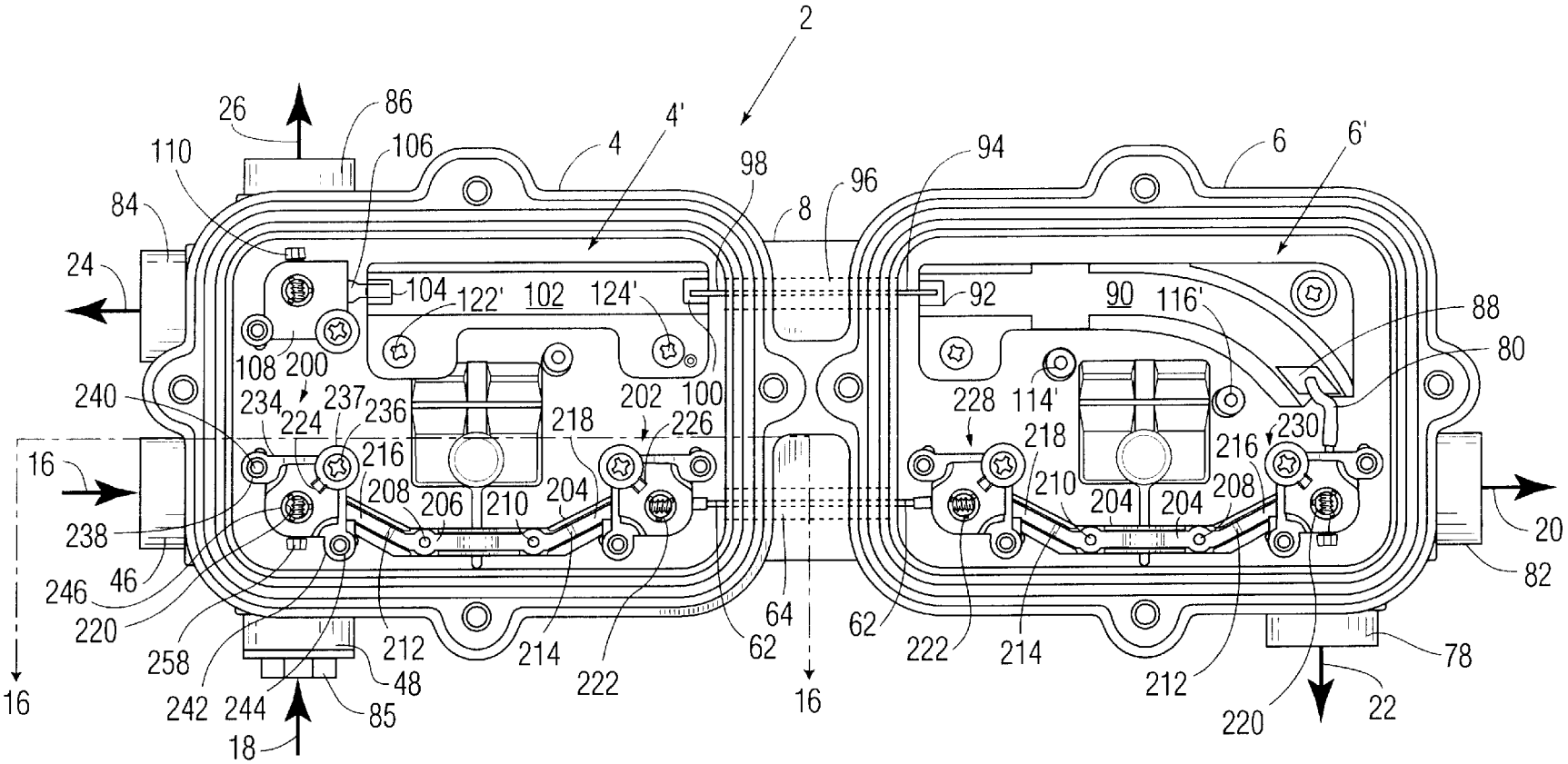
FIG. 14 is a bottom view of a preferred embodiment of a multi-tap of this invention in which RF and AC pass through the multi-tap in one direction and then pass through it in the opposite direction.

FIG. 14 is the same as FIG. 13 except that the lead 80 is connected to the cable seizure means 230 so as to conduct RF and AC power back through the multi-tap 2 to cables coupled to either of the coax connectors 84 and 86.

The structure of the cable seizure means 200, 202, the bridge member 204 and the transmission line 206 will now be described. Since all of the cable seizure means are nearly identical, only the cable seizure means 200 needs description. Corresponding structures in all cable seizure means are identified by the same numbers. In FIG. 13, the cable seizure means 200 is shown as having a cover 234 that is attached to the bottom of the compartment 4' by a threaded bolt 236 having a shank that passes through a hole 237 in the cover 234 that is not visible because it is covered by the head of the bolt 236. The bolt 236 is threaded into a riser, not shown, that extends vertically from the bottom of the compartment 4'. An opening 238 in the cover 234 is concentric with a post 240 extending from another vertical riser, not shown, and an opening 242 is concentric with another post 244 extending from a third vertical riser, not shown. A circular opening 246 in the cover 234 surrounds the hollow cylindrical upper portion 220 for the cable seizure means 200. An opening 225 (See FIG. 16) in the cover 234 provides for sliding passage of the cam 224.

Figure 15:
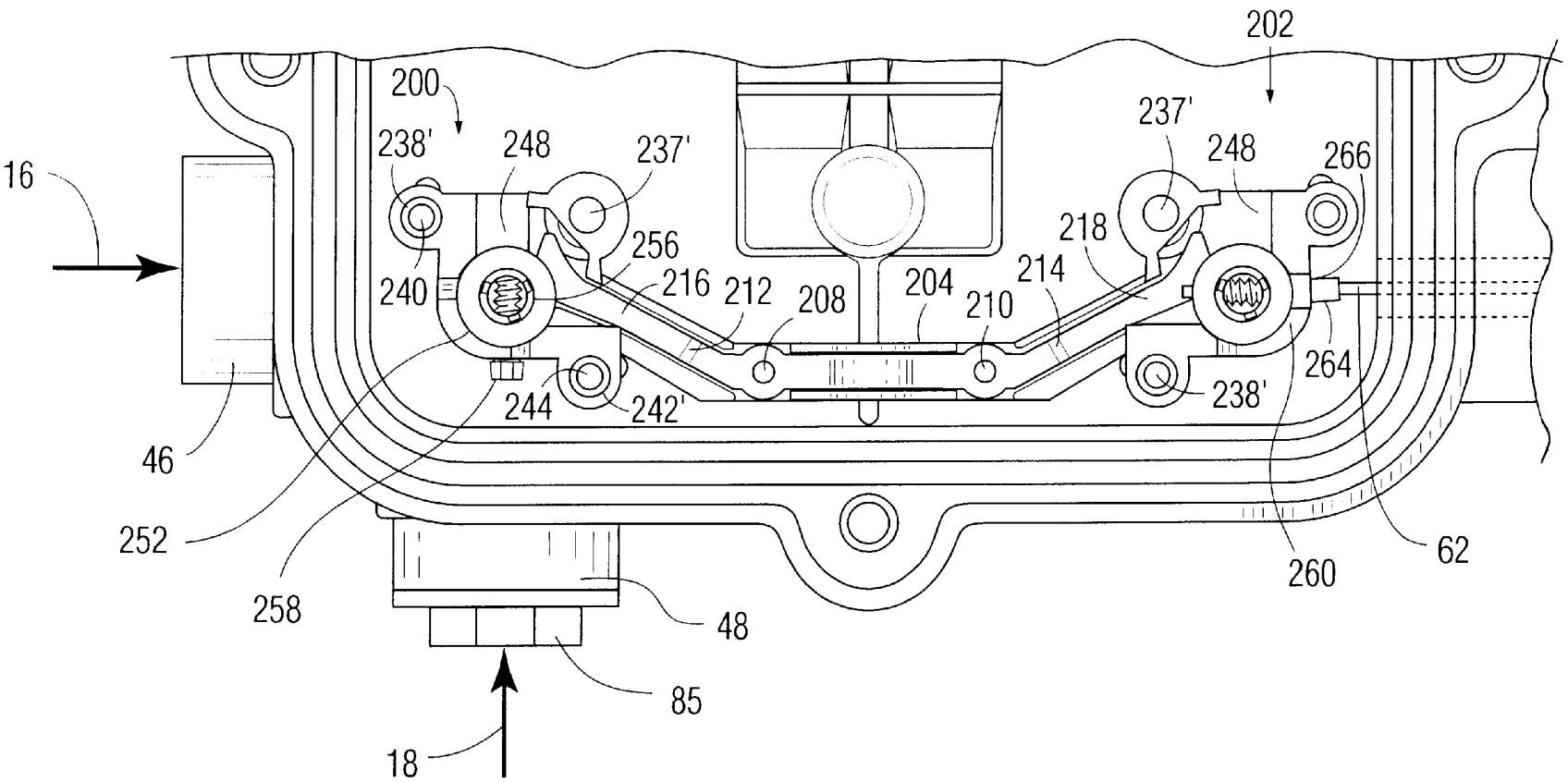
FIG. 15 is an enlarged view of a portion of FIG. 13.
Figure 16:
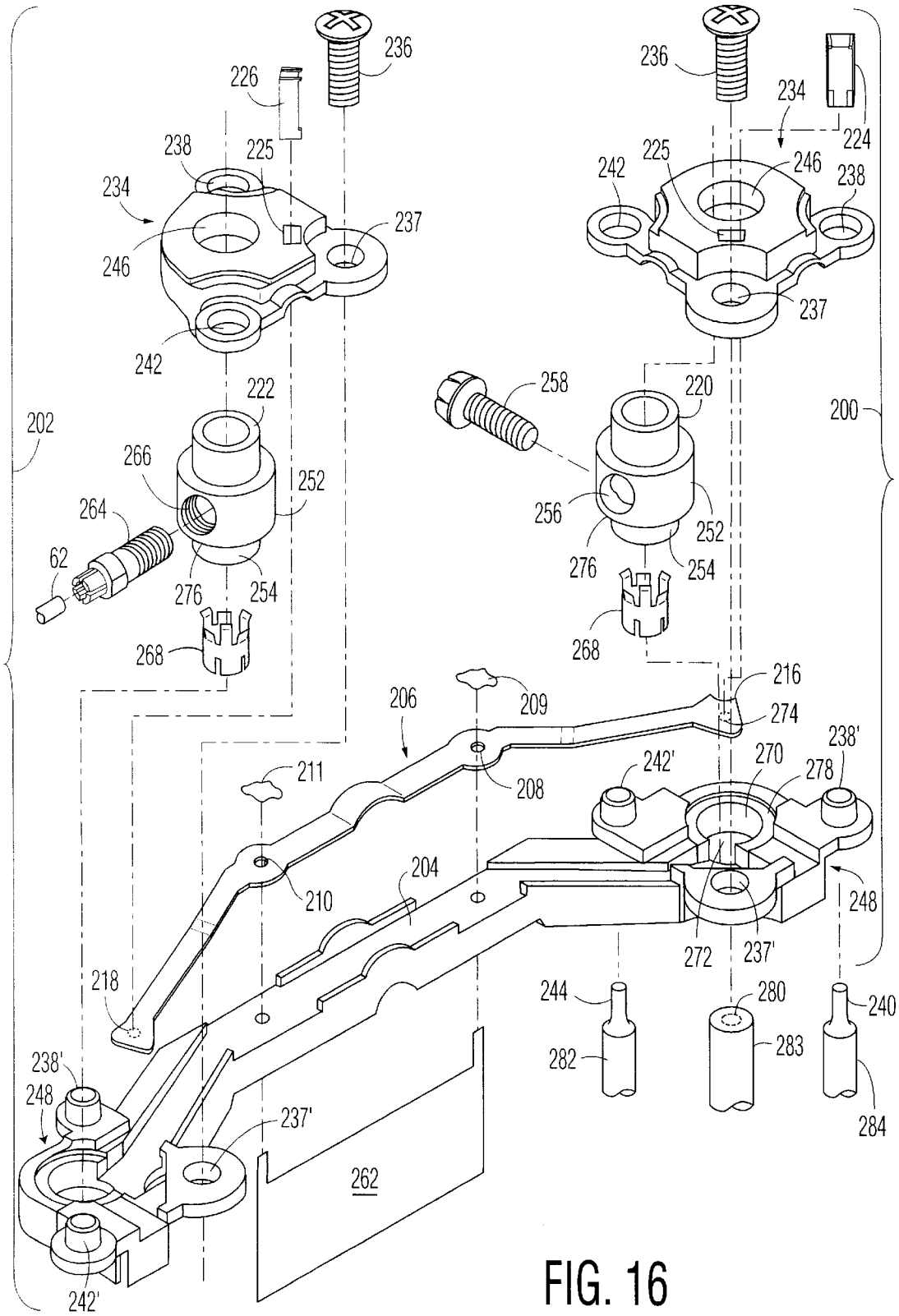
FIG. 16 is an exploded assembly view of a preferred embodiment of cable seizure means of this invention.

When the cover 234 is removed by unscrewing the bolt 236, a base 248 of the cable seizure means 200 appears as shown in FIG. 15. As shown in FIG. 16, the base 248 has hollow cylindrical projections 238' and 242' that respectively extend into the openings 238 and 242 in the cover 234 and which encircle the posts 240 and 244. An opening 237' in the base 248 encircles the shank portion of the bolt 236, but the bolt 236 is not shown in FIG. 15 because it has been removed.

As shown in FIGS. 15 and 16, the hollow cylinder 220 of the metal cylindrical structure within the cable seizure means 200 is above a circular hub 252 of larger diameter. As shown in FIG. 16, a lower cylinder 254 of the metal cylindrical structure for the cable seizure means 200 has the same diameter as the upper cylindrical upper portion 220. The metal cylindrical structure 220, 252, 254 is mounted between the cover 234 and bottom 248 so that it can be rotated about its axis. A diametric passageway 256 passes through the hub 252, and a set screw 258 is threaded into the hub 252 so as to meet the passageway 256 at right angles. As shown in FIG. 15, the passageway 256 is aligned so that it can receive the central conductor of a cable attached to the coax connector 46, but by rotating the metal cylindrical structure 220, 252, 254 clockwise by 90°, the diametric passageway 252 will be aligned with the central conductor of a cable coupled to the connector 48. In either position the set screw 258 can be tightened against the central conductor of the cable.

The bridge member 204 is molded with the base 248 of the cable seizure means 200 and a base 248 of the cable seizure means 202 to form an integral plastic structure. The base 248 of the cable seizure means 202 is identical to the base 248 of the cable seizure means 200, and its cover 234, FIG. 13, is the same as the cover 234 of the cable seizure means 200. As previously stated, the transmission line 206 is attached at 203 and 210 to the bridge 204, and, as shown in FIG. 16, a conductive plate 262 is attached at the same points so as to extend perpendicularly toward the bottom of the compartment 4'. The plate 262 provides the desired impedance for the transmission line 206.

As shown in FIG. 15, one end of the bridge member 204 meets the base 248 of the cable seizure means 200 at a point between the opening 237' and the opening 242' and below the bottom of the hub 252 so that the end portion 216 of the transmission lines 206 is pressed downwardly by the hub 252. Actually, as shown in FIG. 16, tip 274 of the end portion 216 is in contact with the hub 252. Similarly, the other end of the bridge member 204 meets the base 248 of the cable seizure means 202 at a point between the opening 237' and the opening 242' and below the bottom of the hub 252 so that the end 218 of the transmission line 206 is pressed downwardly by the hub 252.

In view of the fact that metal cylindrical structure 220, 252, 254 of the cable seizure means 202 is permanently connected to the conductor 62 that carries RF and AC power from the compartment 4' to the compartment 6', no diametric passageway through the hub 252 is required, but one could be present. Therefore, as shown in FIG. 16, the metal cylindrical structure 222, 252, 254 of the cable seizure means 202 does not have a diametrical passageway. A ferrule 264 that is threaded into an opening 266 such as used for the thumbscrew 258 is soldered to the conductor 62 as indicated.

Figure 17B:
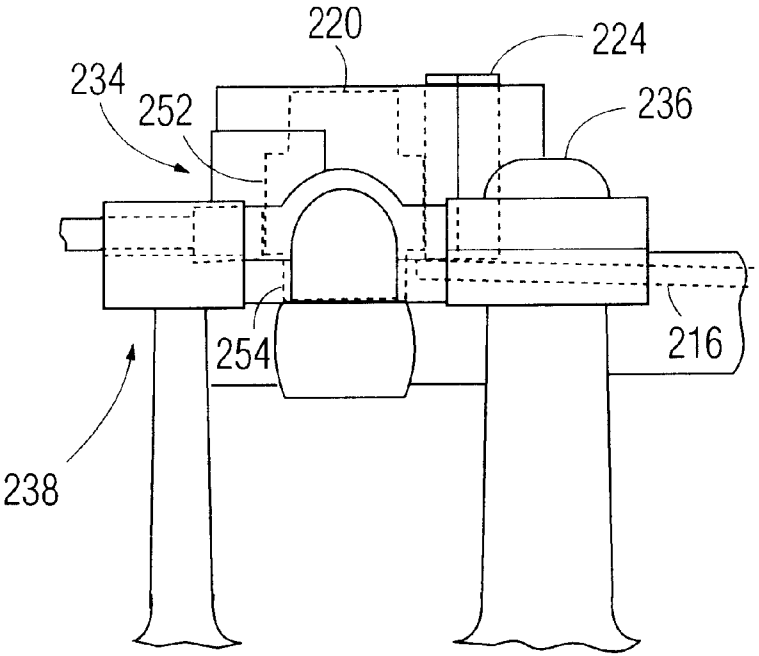
FIG. 17B is a schematic illustration of a switch using an end of a transmission line as the switching element when the switch is open.
Figure 17A:
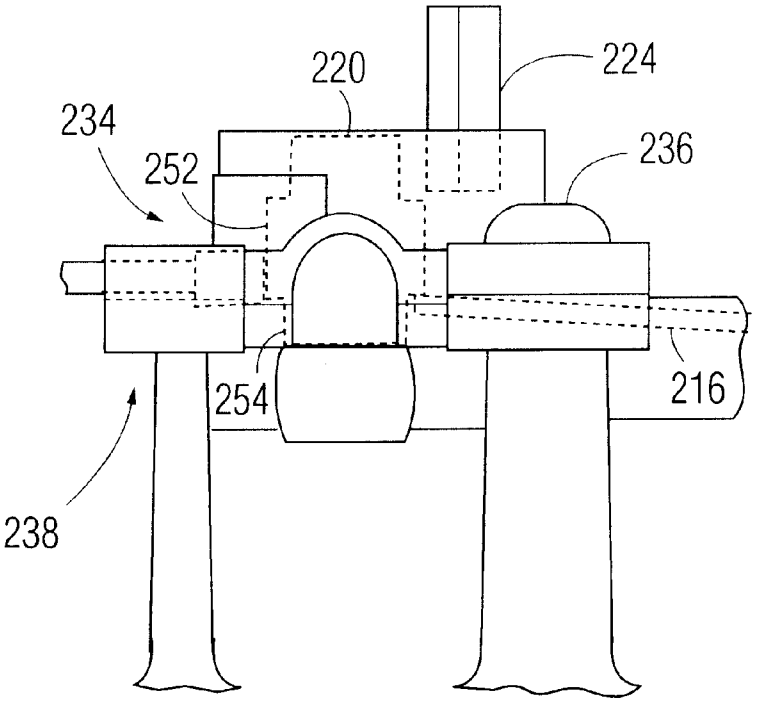
FIG. 17A is a schematic illustration of a switch using an end of a transmission line as the switching element when the switch is closed.

FIG. 17A illustrates the closed portion of the switch formed by an annular ridge 276 between the hub 252 of the metal cylindrical structure 220, 252, 254 of the cable seizure means 200 and the end 216 of the transmission line 206 when the compartment 4' is open so that the cam 224 merely sits on the end 216. But, when the compartment 4' is closed by the cover 10, the cam 224 is pushed downward so as to force the end 216 of the transmission line 206 out of contact with the ridge of the hub 252 as shown in FIG. 17B.

Reference is again made to the exploded view of FIG. 16 for a more detailed description of the preferred integral cable seizure structure of this invention. Since the interfitting of parts for the cable seizure means 200 and 202 are the same, only the cable seizure means 200 need be described. After a ferrule 268 is inserted into the lower hollow cylinder 254 of the metal cylindrical structure 220, 252, 254, the structure is mounted on the base 248 so that the lower cylinder 254 extends into a partial cylinder 270 of slightly larger diameter to permit the structure to rotate. An axial slit 272 is provided in the upper portion of the cylinder 270 so as to permit the tip 274 of the transmission line 206 to lie under an annular ridge 276 formed by the hub 252 and the lower cylinder 254 of the cylindrical metal structure 220, 252, 254. In order to provide a close fit, an arc 278 is formed in the tip 274 that has the same radius as the lower cylinder 254. Note that the end portion 216 of the transmission line 206 is bent upwardly so that the tip 274 is initially located just above the top of the axial slit 272.

The cover 234 is lowered so that the upper cylindrical portion 220 of the metal cylindrical structure 220, 252, 254 passes through opening 246 and the openings 242 and 238 fit over the projections 242' and 238'. The cam 224 passes through the opening 225. At some point, the annular ridge 276 of the metal cylindrical structure 220, 252, 254 engages the tip 274 of the transmission line 206 and forces it downward so that the transmission line 206 acts as a tensioned spring. Finally, the annular ridge 276 strikes the top 278 of the partial cylinder 270. At this point the bolt 236 is passed through the opening 237 in the cover 234 and the like opening 237' in the base 248 and screwed into threads 280 in a riser 283. The base 248 is oriented so that the post 244 on a riser 283 passes into the projection 242' and the post 240 on a riser 284 passes into the projection 238'.

The foregoing description also applies to the assembly of the cable seizure means 202.

Although various embodiments of the invention have been shown and described in detail herein, they are not meant to be limiting. Those of skill in the art may recognize certain modifications to these embodiments, which modifications are meant to be covered by the spirit and scope of the appended claims.

What is claims is:

1. A multi-tap for distributing RF signals and AC power from a cable system to a plurality of subscribers via subscriber cables, comprising:

a housing having first and second ends;

a first compartment having a first input port and a first output port at said first end of said housing;

a second compartment having a second output port at said second end of said housing;

a first coaxial line between said first and second compartments;

a first microstrip located in said first compartment electrically connected between said first input port and one end of said first coaxial line;

a first cover for said first compartment having a first circuit thereon;

means integral with said first microstrip for substituting said first circuit for said first microstrip when said first cover is positioned to close said first compartment;

a second microstrip located in said second compartment having one end connected to another end of said first coaxial line;

a second coaxial line between said first and second compartments;

a third microstrip located in said first compartment, one end of said third microstrip being connected to an end of said second coaxial line;

means for coupling the other end of said third microstrip to said first output port;

a fourth microstrip located in said second compartment, one end of said fourth microstrip being connected to the other end of said second coaxial line;

means in said second compartment for electrically connecting the other end of said second microstrip to said second output port or to the other end of said fourth microstrip;

a second cover for said second compartment having a second circuit thereon;

means integral with said second microstrip for substituting said second circuit for said second microstrip when said second cover is positioned to close said second compartment; and at least one of said first and second circuits on said first and second covers respectively having a plurality of subscriber output connectors for coupling to subscriber cables, respectively.

2. A multi-tap as set forth in claim 1 further comprising;

means for grounding the ends of said third microstrip when the other end of said second microstrip is connected to said second output port; and means for grounding the ends of said fourth microstrip when the output of said second microstrip is connected to said second output port;

whereby said third and fourth microstrips will not interfere with RF signals passing through said first and second microstrips.

3. A multi-tap as set forth in claim 1, further comprising:

a third output port on a side of said housing near its first end; and said means for coupling the other end of said third microstrip to said first output port includes means for selectively coupling the other end of said third microstrip to said third output port.

4. A multi-tap as set fourth in claim 1 further comprising:

a fourth output port on one side of said housing near its second end; and said means for selectively electrically connecting the other end of said second microstrip to said second output port or to the other end of said fourth microstrip including means for selectively connecting the other end of said second microstrip to said fourth output port.

5. A multi-tap comprising:

a housing having first and second compartments therein;

a coaxial line interconnecting said compartments;

an input port at a first end of said housing communicating with said first compartment;

an output port at the second end of said housing communicating with said second compartment;

a first microstrip in said first compartment coupling said input port to said coaxial line;

a second microstrip in said second compartment coupling said coaxial line to said output port;

a first cover for said first compartment having a circuit thereon;

means integral with said first microstrip for substituting the circuit on said first cover for said first microstrip when said first cover closes said first compartment;

a second cover for said second compartment having a circuit thereon;

means integral with said second microstrip for substituting the circuit on said second cover for said second microstrip when said second cover closes said second compartment; and at least one of said covers having subscriber outlets coupled to the circuit thereon.

6. A multi-tap as set forth in claim 5 further comprising:

a second coaxial line interconnecting said first and second compartments;

a third microstrip in said first compartment having one end coupled to said second coaxial line and its other end coupled to an output port at said first end of said housing;

a fourth microstrip located in said second compartment, one end of said fourth microstrip being coupled to said second coaxial line and the other end of said fourth microstrip being free; and means in said second compartment for coupling said second microstrip to said output port or to the free end of said fourth microstrip.

7. A multi-tap as set forth in claim 6 further comprising:

a conductive member mounted in contact with said second compartment and the ends of said third microstrip so as to short out said third microstrip; and a conductive member mounted in contact with said first compartment and the ends of said fourth microstrip so as to short out said fourth microstrip.

8. A multi-tap comprising:

an elongated housing having first and second ends and first and second sides;

first and second compartments in series in the order named between said first and second ends of said housing;

a first input port at said first end of said housing;

a second input port on said first side of said housing near its first end;

a first output port at said second end of said housing;

a second output port on said first side of said housing near its second end;

a first cable seizure means in said first compartment near said first end of said housing, said first cable seizure means being adjustable to be coupled to a cable connected to either of said first and second input ports;

a first coaxial line between said first and second compartments;

a second cable seizure means in said first compartment coupled to said first coaxial line;

a first microstrip coupled between and integral with said first and second cable seizure means;

a first cover for said first compartment having a first circuit thereon;

said first cover, said first and second cable seizure means and said first microstrip being constructed so that said first circuit is substituted for said first microstrip when said first cover closes said first compartment;

a third cable seizure means located in said second compartment coupled to said first coaxial line;

a fourth cable seizure means located in said second compartment;

a second microstrip coupled between and integral with said third and fourth cable seizure means;

a second cover for said second compartment having a second circuit thereon;

said second cover, said third and fourth cable seizure means and said second microstrip being constructed so that said second circuit is substituted for said second microstrip when said second cover closes said second compartment;

a second coaxial line between said first and second compartments;

a third output port on said first end of said housing;

a fourth output port on said second side of said housing near its first end;

a fifth cable seizure means located in said first compartment;

a third microstrip connected between said fifth cable seizure means and one end of said second coaxial line;

said fifth cable seizure means being capable of selectively coupling said third microstrip to a cable coupled to either of said third and fourth output ports;

a fourth microstrip having one end connected to the other end of said second coaxial line, its other end being free; and said fourth cable seizure means being selectively connectable between said second microstrip and said free end of said fourth microstrip.

9. A multi-tap as set forth in claim 8 further comprising:

means for grounding the ends of said third microstrip when said fourth cable seizure means couples said second microstrip to a cable coupled to either of said first and second output ports; and means for grounding the ends of said forth microstrip when said fourth cable seizure means couples said second microstrip to a cable coupled to either of said first and second output ports.

10. A multi-tap comprising:

a housing;

a first compartment in said housing having first and second ends;

a second compartment for said housing having a first end adjacent the second end of said first compartment and a second end remote from the first end of said first compartment;

a first coaxial cable connector on said housing near the first end of said first compartment;

a second second coaxial cable connector on said housing near the second end of said second compartment;

a third coaxial cable connector on said housing near said first end of said first compartment;

first and second coaxial lines formed between the second end of said first compartment and the first end of said second compartment, each of said coaxial lines having a central connector;

a first cable seizing means in said first compartment mounted to as to receive a central conductor of a cable coupled to said first coaxial cable connector;

a second cable seizing means mounted in said first compartment so as to receive one, end of said central conductor of said first coaxial line;

a third cable seizing means mounted in said second compartment so as to receive the other end of said central conductor of said first coaxial line;

a first transmission line mounted in said first compartment;

means for coupling one end of said first transmission line to a cable coupled to said third coax connector;

means for connecting the other end of said first transmission line to one end of the central conductor of second coaxial line;

a second transmission line mounted in said second compartment;

means for coupling one end of said second transmission line to the other end of the central conductor of said second coaxial line;

a fourth cable seizure means for receiving the central conductor of a cable coupled to said second coax connector or a lead connected to the other end of said second transmission line;

each of said first, second, third, and fourth cable seizure means having a metal member mounted within them so as to be in contact with a received conductor;

a third transmission line having flexible ends;

said third transmission line being mounted in said first compartment with its ends respectively resiliently forced into contact with the metal members in said first and second cable seizure means;

a fourth transmission line having flexible ends;

said fourth transmission line being mounted in said second compartment with its ends respectively resiliently forced into contact with the metal members in said third and fourth cable seizure means;

cams in each of said cable seizing means for pushing the end of a transmission line in contact with its metal member out of said contact when activated;

a first cover for said first compartment having a first circuit therein and conductive projections from the ends of said circuit;

said cams of said first and second cable seizure means being activated by said first cover just after said projections respectively make contact with their respective metal members as said first cover is closing said first compartment;

a second cover for said second compartment having a second circuit thereon and conductive projections from the ends of said circuit; and said cams of said third and fourth cable seizure means being activated by said second cover just after said latter projections respectively make contact with their respective metal members as said second cover is closing said second compartment.

* * * * *